United States Patent [19]

Dorémus et al.

[11] 4,442,902

[45] Apr. 17, 1984

[54] REMOTE HYDRAULIC CONTROL METHOD AND APPARATUS, NOTABLY FOR UNDERWATER VALVES

[75] Inventors: Bernard Dorémus, Echouboulains; Jean-Pierre Muller, Cesson, both of France

[73] Assignee: Schlumberger Technology Corporation, New York, N.Y.

[21] Appl. No.: 315,573

[22] Filed: Oct. 27, 1981

[30] Foreign Application Priority Data

Oct. 31, 1980 [FR] France ..... 80 23656

[51] Int. Cl.[3] ..... E21B 43/12

[52] U.S. Cl. ..... 166/374; 166/364; 166/375

[58] Field of Search ..... 166/72, 364, 374, 375; 137/625.66; 251/26; 60/416

[56] References Cited

U.S. PATENT DOCUMENTS

| | | | |
|---|---|---|---|
| 3,786,867 | 1/1974 | Taush et al. | 166/375 |
| 3,877,484 | 4/1975 | Theriot et al. | 137/625.66 |
| 3,967,647 | 7/1976 | Young | 137/614.11 |
| 3,993,100 | 11/1976 | Pollard et al. | 137/628 |
| 4,197,867 | 4/1980 | Roger | 251/26 |
| 4,252,197 | 2/1981 | Pringle | 166/322 |
| 4,308,884 | 1/1982 | Hoerger et al. | 166/72 |

*Primary Examiner*—Stephen J. Novosad
*Assistant Examiner*—William P. Neuder

[57] ABSTRACT

The invention relates to a hydraulic method and apparatus for the remote hydraulic control of a device connected to a hydraulic fluid source by means of at least one flexible line filled with hydraulic fluid.

Hydraulic energy is accumulated in the flexible line by increasing the pressure of the hydraulic fluid in the line so that the line increases in volume. The pressure is maintained in the line so that the hydraulic energy thus accumulated by the expansive deformation of the line may be used rapidly to control the device.

The invention finds particular application in the control of an underwater valve in the petroleum industry.

7 Claims, 9 Drawing Figures

REMOTE HYDRAULIC CONTROL METHOD AND APPARATUS, NOTABLY FOR UNDERWATER VALVES

BACKGROUND OF THE INVENTION

1. Field of the Invention

The present invention relates to hydraulic methods and apparatus for the remote hydraulic control of a device, such as an underwater valve placed in a petroleum well. The invention uses only hydraulic techniques and the control is rapid.

2 The Prior Art

It is known that in petroleum wells, valves known as safety valves are placed at given locations of the well and are designed to close the well if necessary so as to avoid a blowout. Thus, for offshore wells, a blowout preventer is placed on the well-head at sea floor level. In addition, when offshore production tests are carried out from a floating platform, a valve or a set of valves is placed removably near the blowout preventer in the production string. Hence, if it is necessary to abandon the well temporarily, for example as a result of a storm, the valves are closed by a control from the surface and the part of the production string located above the valves is disconnected and brought up to the platform which is then no longer connected to the well. These valves are generally controlled hydraulically from the surface. To accomplish this, hydraulic lines connect the valves to be controlled to a hydraulic fluid source located on the surface of the platform. These lines are advantageously flexible, thereby allowing them to be handled easily and making it possible to place the lines in the well with the lines already connected to the valves, the lines and the valves being installed together. These devices operate satisfactorily when the well-head is not at too great a depth, i.e. when the length of the flexible lines is not too long and, in practice, does not exceed about 300 meters. Beyond this length, the response time of the device, i.e. the time required for opening or closing the valve, becomes undesirably long. This is a serious disadvantage when it is necessary to close a valve very rapidly so as to prevent the blowout of a well. This delay is due mainly to the fact that use is made of a flexible line which has the drawback of expanding as the pressure of the hydraulic fluid increases. It will be noted that the response time increases with the length of the lines.

To overcome this drawback, different solutions have been proposed. A first solution consists in using a battery of hydraulic fluid accumulators of higher capacity on the surface so as to obtain a large hydraulic fluid flow in the lines when the valve is opened or closed. It was thus hoped to reduce the control time. In fact, the lines used are generally of small diameter (about 4.8 mm). This results in significant pressure drops which limit and stabilize the hydraulic fluid flowrate in the lines.

It would also be possible to consider using rigid, and hence non-expanding, lines but one also comes up against a problem of pressure drops in the lines, and hence a limited flowrate, and the handling of the rigid piping is not at all practical.

Other solutions consist of using additional hydraulic fluid accumulators and placing them in the well, at the bottom, in the immediate vicinity of the valves to be controlled. In one of these solutions, the accumulators are controlled by means of hydraulic control valves actuated from the surface through hydraulic lines connecting these control valves to the surface. The opening or closing of these control valves is accomplished by varying the hydraulic pressure in the hydraulic control lines. It is then noted that the hydraulic lines are used only for controlling the main underwater valve, through the control valves, but not to furnish the hydraulic energy necessary for opening or closing the main underwater valve. In that system, the hydraulic control circuits and the hydraulic actuating circuits (i.e. furnishing the energy) are separate.

Another solution is described in the review "Offshore" of May 1979, pages 124–126. A battery of hydraulic fluid accumulators is also used in the well in the vicinity of the valves to be controlled. The accumulators are actuated by means of pyrotechnical valves triggered from the surface by means of an electric cable. This solution, while yielding remarkable performance, is complicated because it makes use of both hydraulic techniques and electrical techniques. Moreover, when the pyrotechnical valves have been triggered, they can no longer be used: the system will thus not operate repetitively. Generally, the use of accumulators placed in the well entails many drawbacks. They are in fact cumbersome and must be protected from shocks and from the fluids surrounding them. In addition, the pressure of the hydraulic fluid filling the accumulators must be adjusted from the surface taking into account the pressure prevailing in the well at the depth at which they are to be placed. This pressure adjustment calls for an auxiliary fluid source as well as a skilled operator. Similarly, when the accumulators are empty, it is necessary to bring the entire device up to the surface in order to recharge the accumulators. The device can thus be used for only a limited number of valve-actuation repetitions.

SUMMARY OF THE INVENTION

The invention provides a method and a system corresponding better than those of the prior art to the requirements of the practice, particularly in that it does not present the drawbacks mentioned above. The invention provides a method and a system for controlling a device using only hydraulic means and flexible lines, even if this device is located at a great distance from the hydraulic fluid source, and with the shortest possible response time, since the control system is completely hydraulic. It is also an object of the invention to provide a device which is easy to use, lower in manufacturing cost than that of existing designs and requiring simplified maintenance. The system also operates in a repetitive manner without having to be brought up to the surface after one or several actuations.

One of the main ideas of the present invention is to benefit from the major drawback of existing designs, namely the expansion of the flexible hydraulic lines.

Precisely, the invention proposes a method for the remote hydraulic control of a device connected to a hydraulic fluid source by at least one flexible line. The method comprises accumulating hydraulic energy in the line by increasing the pressure of the hydraulic fluid filling the line so that the line increases in volume, and maintaining the pressure in the line so that the hydraulic energy thus accumulated may be used rapidly to control the device.

The invention also provides a system for the remote hydraulic control of a device. The system comprises a hydraulic fluid source connected to the device by at least one flexible line, means located at the end of the flexible line, for distributing the hydraulic fluid, to effect control of the device and accumulation of hydraulic energy by the deformation of said line obtained by increasing the pressure of said hydraulic fluid so as to obtain and to maintain an increase in volume in said line.

BRIEF DESCRIPTION OF THE DRAWINGS

The invention will be better understood from the following description of an embodiment of the invention given by way of nonlimitative example. The description refers to the accompanying drawings in which.

THE PREFERRED EMBODIMENT

Figure 1:
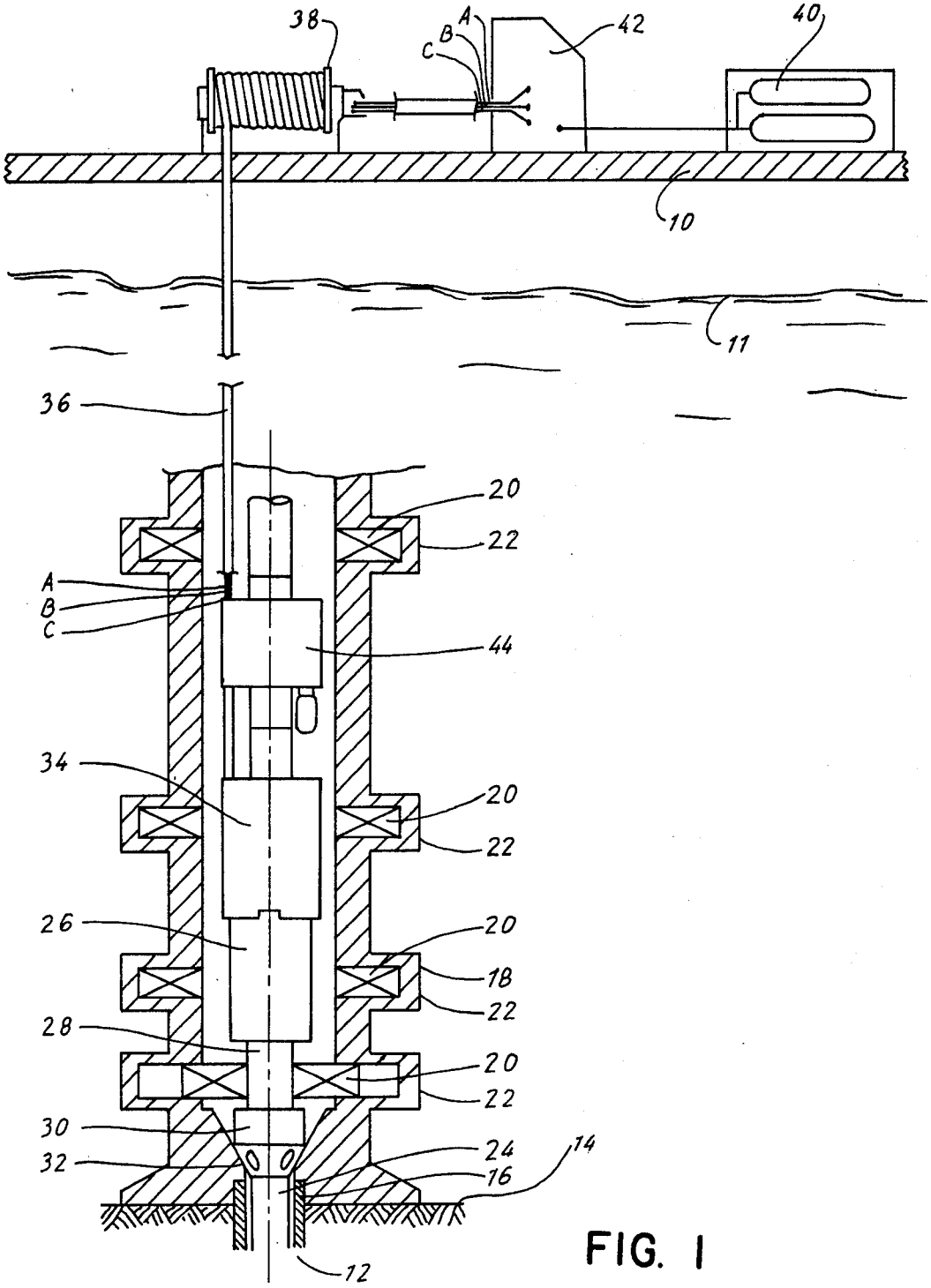
FIG. 1 represents schematically a system according to the invention for the control of a valve placed removably in an underwater well-head during offshore production tests from a floating platform.

Referring to FIG. 1, the deck of a floating or semi-submersible drilling platform 10 is shown over an offshore well 12. The surface of the sea is represented by 11 and the sea floor by 14. On a wellhead fixed to the top of a casing 16 is mounted a blowout preventer 18 having packings 20 which can move laterally by means of hydraulic cylinders 22 so as to close the annulus between the casing 16 and a drill string 24 or a production string going through the assembly. A riser, not shown, is coupled to the upper end of the blowout preventer 18 and extends upward to the surface where it is fixed to the platform by a constant tension device (not shown).

Inside the blowout preventer 18 is placed a gate valve 26 connected to the drill string 24 running from the surface to the formation under test. This valve, as well as a method for its hydraulic control, is described in detail in U.S. Pat. No. 3,967,647. The valve 26 is connected by a coupling 28 to a drilled support 30 which rests against a suspension surface 32 provided at the lower end of the blowout preventer 18. The lower packings of the blowout preventer close around the coupling 28 while the support 30 is used for suspending the drill string 24 in the well. On the body of valve 26 is removably fixed a hydraulic assembly 34 controlling the valve, which has one or more plugs. The valve 26 and the connection or the disconnection of the hydraulic assembly 34 from the valve 26 are controlled from the platform by means of flexible hydraulic lines A, B and C forming a bundle 36. This bundle is wound on a drum 38 placed on the deck of the platform. The hydraulic fluid filling the lines is supplied by means of accumulators 40 connected to a control desk 42, including a pump. The three hydraulic lines A, B and C start out from this desk.

Figure 2:
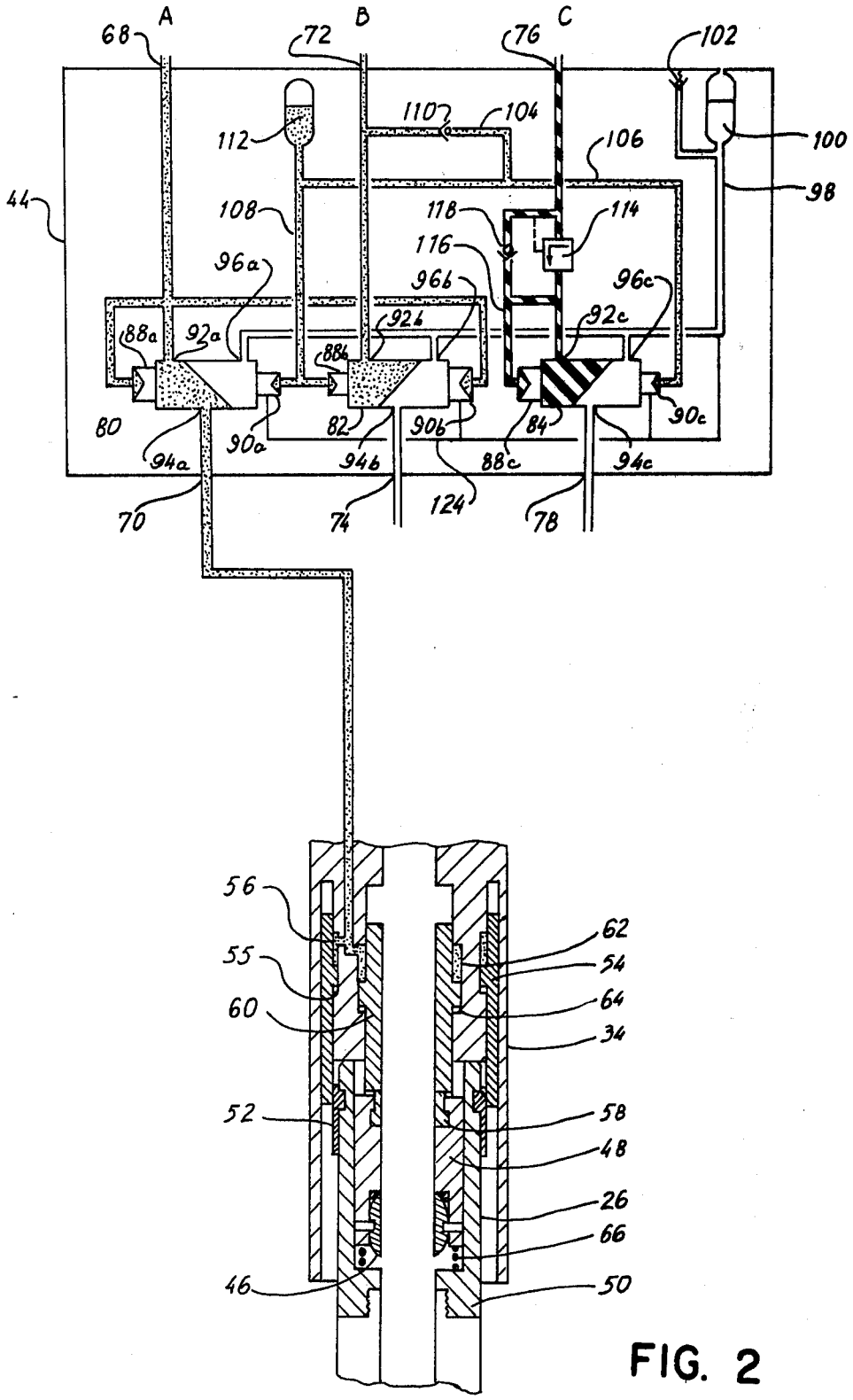
FIGS. 2, 3 and 4 represent schematically the hydraulic means for distributing the hydraulic energy accumulated in the flexible lines as well as the removable valve to be controlled, FIG. 2 concerning the opening of the valve, FIG. 3 the closing of the valve and FIG. 4 the disconnection of the hydraulic control part of the valve.
Figure 3:
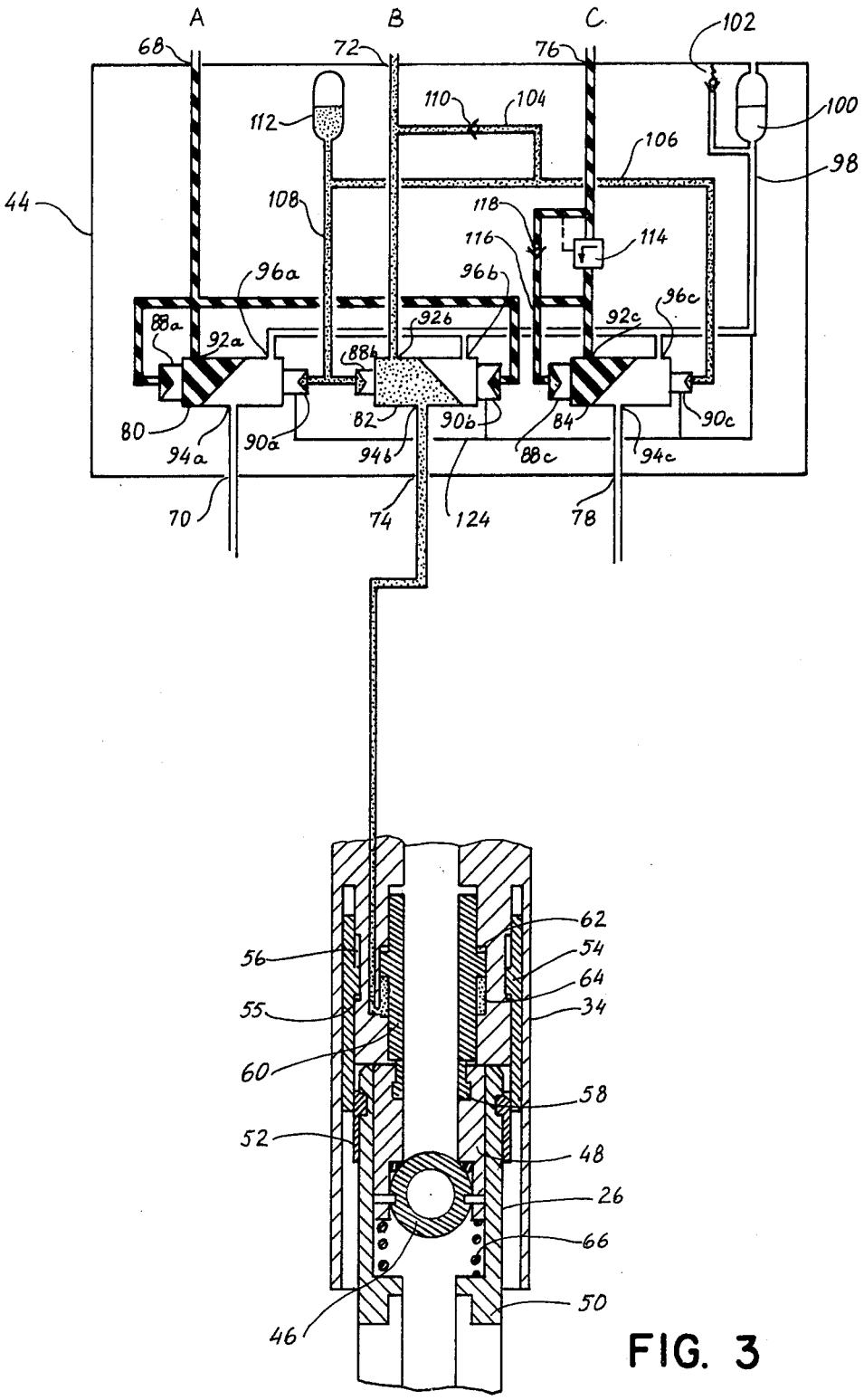
Figure 4:
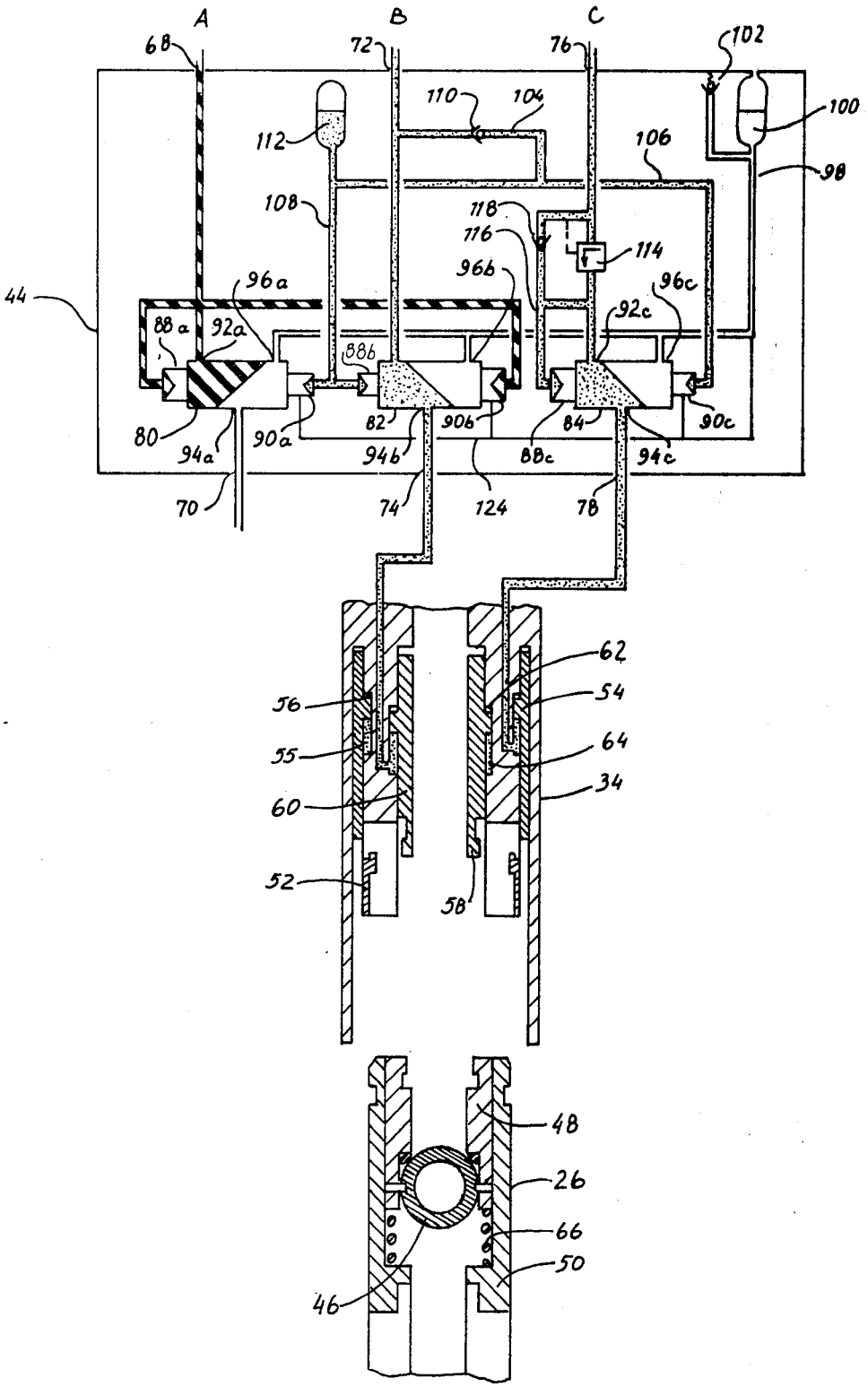
Figure 6:
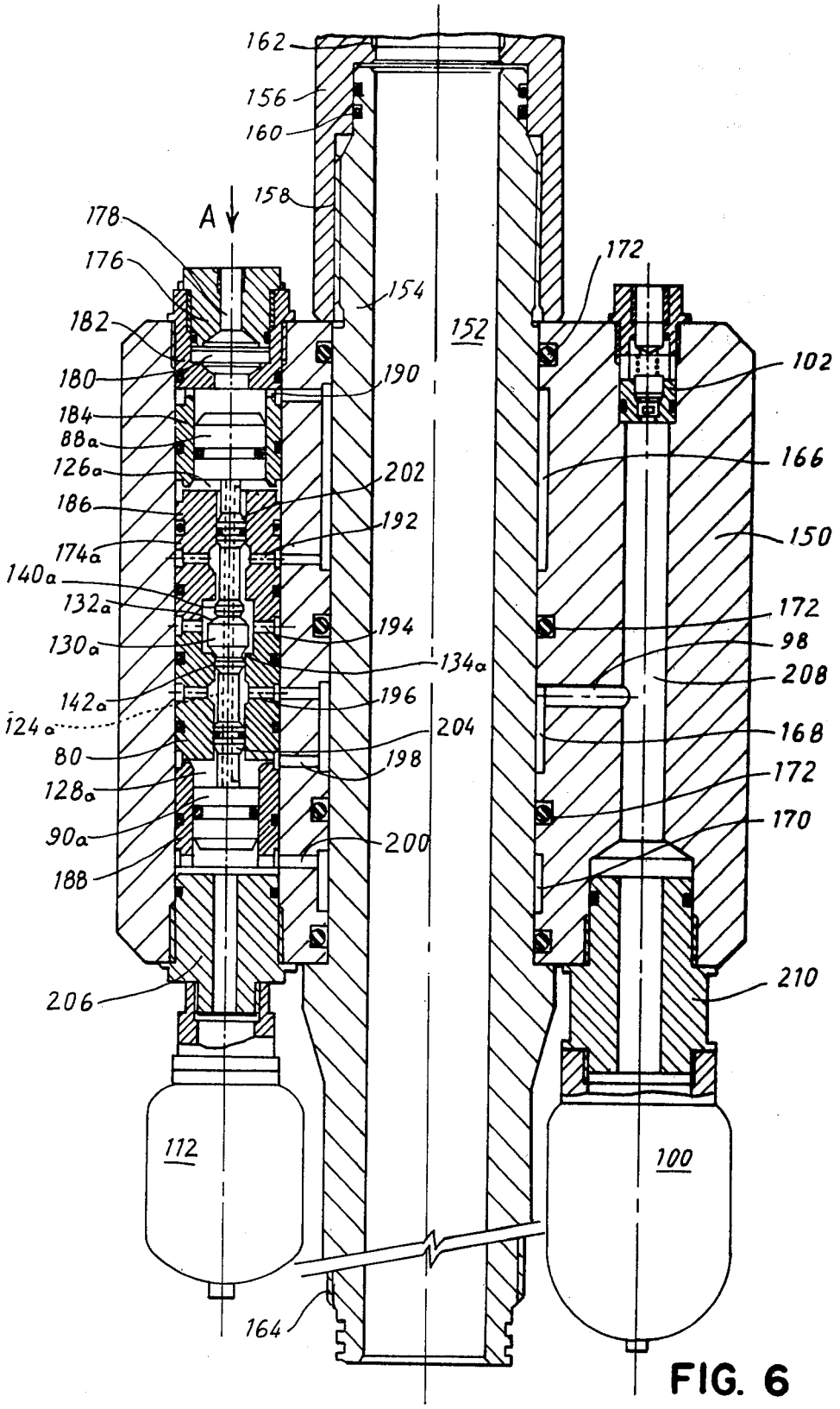
FIGS. 6, 7 and 8 represent an embodiment of the hydraulic energy distribution means associated respectively with the flexible lines A, B and C.
Figure 7:
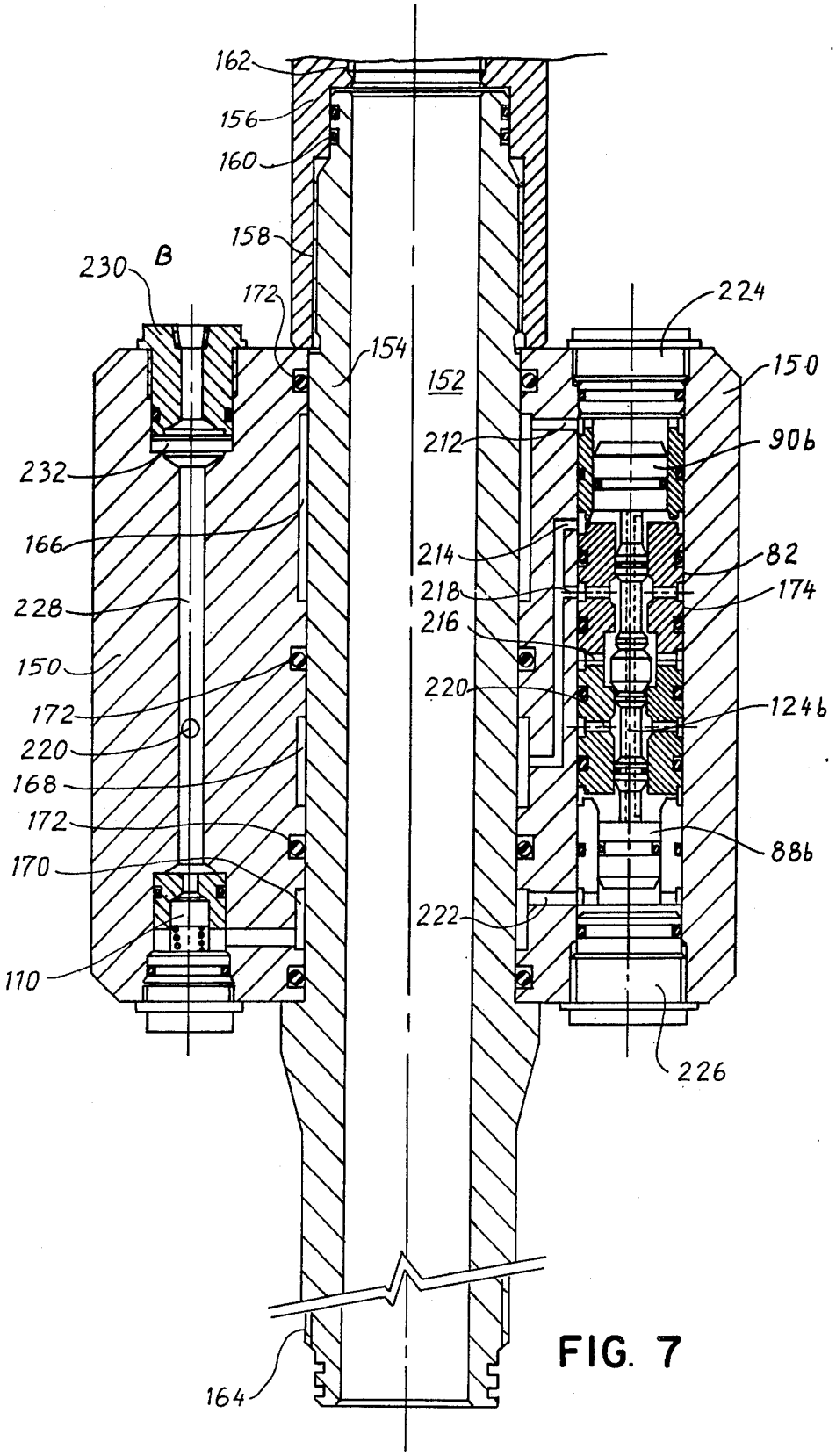
Figure 8:
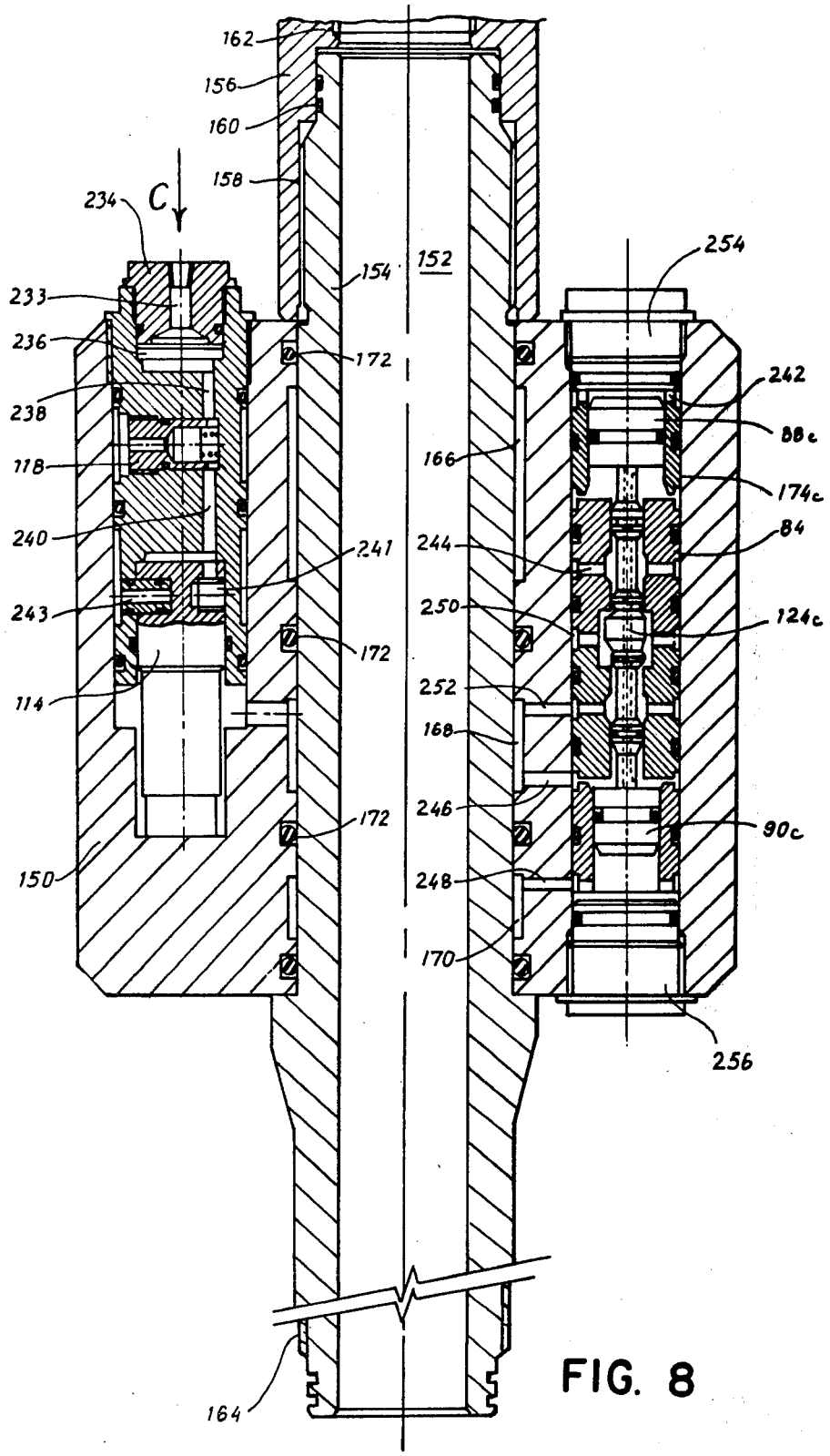

According to one feature of the present invention, the hydraulic lines are not connected directly to the hydraulic assembly 34 but through a hydraulic distribution unit 44 shown in detail in FIGS. 6, 7 and 8 and the hydraulic diagram of which is shown in FIGS. 2, 3 and 4.

In these Figures, the valve 26 and the removable hydraulic control system 34 are shown very schematically. These elements are described completely in U.S. Pat. No. 3,967,647 mentioned above. The valve 26 comprises a ball valve element 46 fixed in a cage 48. The latter is housed in the valve body 50 which is secured to the hydraulic assembly 34 by means of resilient latch fingers 52. These fingers are kept in position by means of a first piston 54 which moves under the action of hydraulic pressure in the chambers 55 and 56. The valve cage 48 is fixed removably by means of resilient latch fingers 58 to a second piston 60. The latter moves under the effect of hydraulic pressure exerted in the chambers 62 and 64. A spring 66 tends to load the cage 48 upward so as to keep the ball valve element 46 in the closed position. The diagram of the hydraulic distribution unit 44 is shown in FIG. 2, the hydraulic line A being shown in hydraulic communication with the hydraulic control assembly 34, the ball valve 46 being kept open and the removable hydraulic assembly 34 being connected to the valve 26. The opening of the ball valve is effected by admitting into the chamber 62 the hydraulic fluid at the pressure A so as to hold down the piston 60. (Hereinbelow, the pressure A, B or C will designate the pressure in the respective hydraulic lines A, B or C.) The mechanical connection of the removable assembly 34 to the valve 26 is locked by holding down the piston 54 by admitting the pressure A into the chamber 56. For this configuration, the inlet 68 of the line A in the hydraulic distribution unit 44 communicates with the outlet 70 of the unit. On the other hand, the inlets 72 and 76 of the lines B and C are not in communication with the outlets 74 and 78 respectively.

The hydraulic distribution unit 44 has three distribution valves 80, 82 and 84 associated respectively with the flexible lines A, B and C. These valves are each of the two-position, three-way type. The positions are determined by the position of a spool 86 (FIGS. 5*a*, 5*b*) subjected to the action of two pistons 88 and 90 of different section ratios depending on the line (A, B, C) with which connected. The section ratio in FIGS. 2–4 of the pistons 88*a* to 90*a* is 1 to 0.8; the section ratio of the pistons 88*b* to 90*b* is 0.8. to 1 and the section ratio of the pistons 88*c* to 90*c* is 1 to 0.6. With the exception of the different section ratios of the pistons, the three distribution valves 80, 82, 84 are identical. The pistons 88*a* and 90*b* are subjected to the pressure A. The three pistons 90*a*, 88*b* and 90*c* are subjected to the pressure B used as reference pressure. The piston 88*c* is subjected to the pressure C.

The three ports of each distribution valve are made up of the pressure inlet 92 in communication with the corresponding hydraulic line (92*a* for line A, 92*b* for line B and 92*c* for line C), a purge port 96*a*, *b* or *c* connected to a purge circuit 98, and a utilization port 94*a*, *b or c* allowing the communication of either the hydraulic line A, B or C or the purge circuit with the hydraulic control assembly 34. The purge circuit includes a transfer accumulator 100 and a stop valve 102 connected to the external surroundings in parallel with the transfer accumulator 100. The accumulator 100 transmits the surrounding external pressure into the low-pressure circuits of the unit, i.e. the circuits not subjected to the pressure A, B or C but subjected to the pressure of the purge circuit. Variations in the volume of this accumulator are compensated automatically during the purging of the hydraulic utilization lines 70, 74 and 78 connecting the hydraulic unit to the assembly 34, thanks to the closure of the stop valve 102. The latter allows the outlet of the fluids, purged toward the exterior of the hydraulic unit, and prevents the ingress of contaminating particles into the circuits. Its closure is adjusted so as to obtain a preferential circuit toward the accumulator 100 before letting out the fluids purged through the stop valve 102.

The flexible line B is connected directly to the pressure inlet **92*b* of the distribution valve 82. The hydraulic pressure B is used as a reference pressure thanks to the reference circuits 104, 106 and 108. This circuit includes a small accumulator 112 whose role is to compensate the small variations in reference pressure when the distribution valves are operated by keeping this pressure constant. The reference pressure circuit also includes a nonreturn valve 110 which makes it possible, in the event of a leak in the line B, to keep the hydraulic fluid in the reference circuit 104-106-108. Between the inlet 76 of the flexible line C in the hydraulic unit and the pressure inlet 92*c* of the distribution valve 84 there is a calibrated valve 114** which opens only with an upstream pressure higher than about 140 bars [2000 pounds per square inch (psi) approximately].

The outlet of the calibrated valve 114 is connected directly to the pressure inlet **92*c* and to the piston 88*c* through passage 116. As the calibrated valve 114 allows the hydraulic fluid of the line C to pass only from the upstream to the downstream direction, it is necessary to place on a bypass with this calibrated valve a nonreturn valve 118 which allows the purging of the passage 116**.

It should be noted that the accumulators 100 and 112 are in fact only expansion tanks which constitute reserves of fluid for the circuits of the hydraulic unit 44 only, but in no case do these accumulators furnish hydraulic energy to the hydraulic control system 34.

A circuit 124 connects the face of the pistons **90*a*, 90*b* and 90*c* in contact with the spool, with the purge circuit so as to balance the pressures and compensate for the variations in the volumes of certain chambers as will be explained further below in reference to FIGS. 5*a* and 5*b***.

Figure 5A:
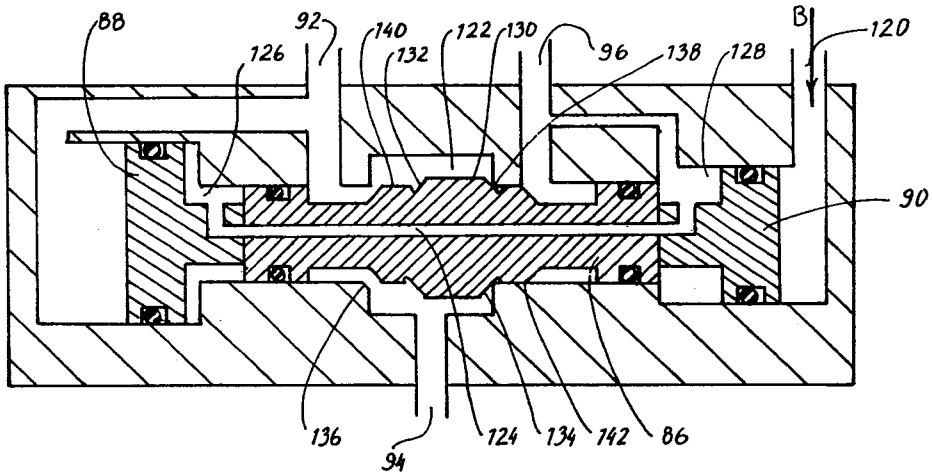
FIGS. 5A and 5B represent schematically, for two different positions, the two-position and three-way distribution valve of which several are used in the hydraulic energy distribution means.
Figure 5B:
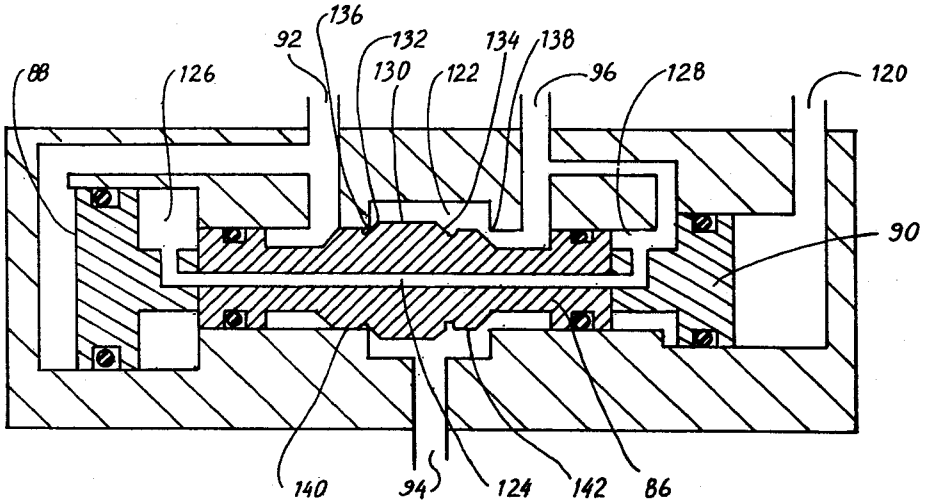

The distribution valves 80, 82 and 84 are shown schematically in FIGS. 5A and 5B for the two positions of their spool. A distribution valve comprises mainly a central spool 86 moving in a longitudinal channel 122 by means of pistons 88 and 90 located on respective ends of the spool. These two pistons have different cross-sectional areas as indicated earlier. The pressure inlet 92 is connected to one of the three lines A, B and C so that the piston 88 moves under the effect of the hydraulic pressure A, B or C. The inlet 120 is connected to the reference pressure circuit, namely to the flexible line B. The piston 90 thus moves under the effect of the pressure B. A communication circuit 124 goes through the spool 86 in order to balance the pressures and to compensate for volume variations in the chambers 126 and 128 located at respective ends of the spool. This circuit is connected to the purge port 96 which communicates with the purge circuit 98. In the position of the spool shown in FIG. 5A, the pressure port 92 communicates with the utilization port 94 so that the hydraulic pressure applied to port 92 (through one of the lines A, B or C) is directed toward the valve control assembly via port 94. For the other position of the spool, shown in FIG. 5B, the purge port 96 is in communication with the utilization port 94 so that the hydraulic utilization line associated with the distribution valve is at the purge pressure, i.e. the exterior pressure. This prevents the crushing of the hydraulic utilization lines which are subjected to the exterior pressure when the pressure A, B or C is not applied.

The spool 86 includes a cylindrical central part 130 equipped at respective ends with a shutoff valve portion 132, 134, cooperating with respective seats 136, 138. Adjacent each shutoff valve portion 132, 134 is a cylindrical part 140, 142. These cylindrical parts are designed, when the spool moves from one position to another, to isolate for an intermediate spool position the three ports 92, 94 and 96. For example, when the spool changes from the position shown in FIG. 5A to that of FIG. 5B, the cylindrical part 140 engages in its recess before the cylindrical part 142 leaves its own recess, thereby isolating all the ports with respect to each other. This arrangement prevents the spool from remaining in the intermediate position, which would be liable, on the one hand, to cause significant drops between the pressure coming from one of the lines A, B and C through the pressure inlet 92 and the purge circuit through the purge ports 96, instead of going toward the utilization port 96 and, on the other hand, to cause an uncertainty regarding the position of the spool which may have begun to vibrate.

Referring again to FIGS. 2–4, the hydraulic distribution unit 44 makes it possible to isolate the hydraulic valve control assembly 34 from the flexible lines A, B and C. These lines are made up of synthetic braiding and can be, for example, the model 3.300 or 3R80, of 4.8 mm diameter, manufactured by the American company Samuel Moore. Of course, the diameter can be different. According to a feature of the invention, the lines A, B and C are kept under sufficient pressure upstream of the distribution unit 44 that the lines A, B and C expand, and increase in volume. Hydraulic energy is thus accumulated in these lines. This hydraulic energy thus accumulated is released, by means of the distribution unit, to control rapidly the hydraulic control assembly 34. It is thus realized that the depth at which are located the valve and the hydraulic distribution unit 44 does not represent a limit, because the longer the flexible lines A, B and C, the larger the hydraulic energy reserve accumulated. Similarly, the type of flexible line used can be adapted by suitably choosing the increase in volume of the lines in accordance with the depth of the valve, the utilization pressures and the volume of hydraulic fluid required to control the valve. The increase in the volume of the flexible line, owing to the pressure of the hydraulic fluid, is preferably higher than the volume of hydraulic fluid required to control the valve. The flexible lines are thus used, according to the invention, as accumulators for hydraulic fluid under pressure so as to reduce considerably the response time of the hydraulic system and eliminate the presence of accumulators at the bottom, as used in the (rapid action) devices of the prior art. The hydraulic energy thus accumulated upstream of the distribution unit 44 can become rapidly available downstream of this unit.

In FIG. 2, the hydraulic pressure A is transmitted downstream whereas the pressures B and C are stopped by the distribution valves of the distribution unit 44. The pressures upstream of the unit 44 in the lines A, B and C are respectively about 280 bars (4000 psi), 280 bars (4000 psi) and 140 bars (2000 psi). Owing to the section ratios of the different distribution valve pistons, only the distribution valve 80 transmits the pressure A, the other valves stopping the pressures B and C and placing the outlets 74 and 78 at purge pressure (exterior pressure).

When it is desired to close the ball valve, as shown in FIG. 3, the pressure B is transmitted into the chamber 62 so as to help the spring 66 drive upward the cage 48 of the valve. To achieve this, the pressure in the line A is reduced from the surface to about 140 bars (2000 psi). The spools of the distribution valves 80 and 82 then change position so that valve 80 no longer transmits the pressure A and its utilization outlet 70 is then in communication with the purge port 96*a*. In order for the valve 80 to no longer transmit the pressure A, it is sufficient to reduce the pressure A to a value lower than that given by the section ratio of the pistons 88*a* and 90*a* multiplied by the value of the reference pressure B. The distribution valve 80 then changes position when the pressure A drops to the value of 280 bars (4000 psi) multiplied by 0.8, or about 220 bars (3200 psi). The distribution valve 82 transmits the pressure B downstream. The valve 84 does not change position because the pressures B and C have not changed.

FIG. 4 represents the position for which the ball valve element 46 of the control valve is closed and the hydraulic control assembly 34 is disconnected from the valve so as to allow it to be raised to the surface with the hydraulic distribution unit 44. For this purpose, the two pistons 60 and 54 are moved upward by subjecting the chambers 64 and 55 to the pressures B and C respectively. This is done upstream of the distribution unit 44, the pressure A remaining equal to about 140 bars (2000 psi), the pressure B to about 280 bars (4000 psi) and the pressure C being raised from 140 bars (2000 psi) to about 280 bars (4000 psi). The valve 84 changes position, i.e. the pressure C goes from the upstream to the downstream direction as soon as the pressure C reaches about 170 bars (2400 psi) owing to the section ratios of pistons 88*c* to 90*c* which are 1 to 0.6. The distribution valves 80 and 82 do not change position because the pressures A and B are respectively 140 bars (2000 psi) and 280 bars (4000 psi).

It will be noted that, according to one of the characteristics of the invention, the hydraulic fluids of the lines A, B and C are used as hydraulic energy reserves necessary for actuating the valve 26, but they are also used for controlling the valves 80, 82 and 84 of the hydraulic distribution unit. The lines A, B and C thus serve to provide hydraulic energy and to transmit control information to the hydraulic unit.

FIGS. 6, 7 and 8 give a sectional representation in three different planes of the preferred embodiment of the hydraulic distribution unit 44. It is composed of a block 150 in the form of a sleeve having a longitudinal passage 152 into which fits the section 154 of the production string. The block thus surrounds the production string. It is connected upward in a sealed manner by means of a coupling 156 having a lower internal thread 158 and two O-rings 160. This coupling 156 has an upper internal thread 162 into which is screwed the part of the production string which extends up to the platform. The lower part of the section 154 of the production string is equipped with a thread 164 on which is screwed the upper part of the hydraulic control system 34 of the underwater valve. With the exterior part of the section 154 of the production string, the block 150 forms three annular chambers 166, 168 and 170 in which prevail respectively, the pressure A, the purge pressure and the pressure B. O-rings 172 on each side of these chambers and in contact with the exterior wall of the production string provide the sealing of the chambers.

In FIG. 6, which represents the embodiment of the hydraulic circuits assigned to line A, the hydraulic unit is traversed by a longitudinal channel 174*a* in which is placed the distribution valve 80. The upper end of the channel 174*a* is closed by means of a plug 176 having a central channel 178 into which is screwed the end of the line. A filter 180 in the shape of a disc is placed at the lower end of the plug 176, which is placed in a cage 182. The body of the distribution valve has three hollow cylindrical parts 184, 186 and 188. Radial passages provide communication between certain parts of the valve and the annular chambers. Thus, the passages 190 and 192 communicate with the annular chamber 166 at the pressure A. The passage 194 communicates with the utilization port either at the pressure A or at the pressure of the purge circuit (hence corresponds to 94*a* in FIG. 2). The passages 196 and 198 communicate with the annular chamber 168 at the pressure of the purge circuit. Finally, the passage 200 communicates with the annular chamber 170 at the pressure B. Inside the parts 184 and 188 slide the pistons 88*a* and 90*a* respectively. The section ratio of these pistons is 1 to 0.8. Between these two pistons is located the spool proper of the distribution valve. The identical elements in FIGS. 5A and 5B and in FIGS. 6, 7 and 8 are given the same reference numbers, with the addition of the letter a to designate the hydraulic circuit relative to the line A. Since the distribution valves relative to the three lines A, B and C are identical, like reference numbers will be used to designate like elements with reference to FIGS. 6, 7 and 8, however with the addition of letters a, b and c meaning that what is involved are valves relative to the lines A, B and C respectively and to show that there are in fact three distribution valves.

The spool of the valve includes a central cylindrical part 130*a* equipped on each end with a respective shut-off 132*a*, 134*a* and an overlapping cylindrical surface 140*a* and 142*a*. Adjacent each of these overlapping surfaces there is a piston 202, 204 which is in contact with a piston 88*a*, 90*a*, respectively. The spool is traversed by a longitudinal channel 124*a* allowing communication and balancing of the fluid volumes present in the chambers 126*a* and 128*a*. This channel communicates with the chamber 168 at the pressure of the purge circuit. The lower part of the longitudinal passage 174*a* of the hydraulic unit is connected to the accumulator 112 by means of a coupling 206. A longitudinal passage 208, closed at one end by the stop valve 102 which is calibrated at about 3.5 bars (50 psi), traverses the hydraulic unit symmetrically in relation to the production string. This passage is connected by means of a coupling 210 to the accumulator 100 to place the purge circuit at exterior pressure. The longitudinal passage 208 communicates with the annular chamber at the purge pressure by means of a radial channel 98.

For the position of the spool shown in FIG. 6, the hydraulic lines A and B are at the pressure of 280 bars (4000 psi). The pressure A in the annular chamber 166*a* reaches the utilization port 194 through the channel 192. If the pressure A drops to a value lower than about 220 bars (3200 psi), the spool changes position. The utilization port 194 is then at the pressure of the annular purge chamber 168 through the channel 196. It is noted that, thanks to the overlapping cylinders 140 and 142, there is an intermediate position of the spool for which there is no communication between the three ports of the valve, namely the channels 192, 194 and 196.

FIG. 7 is a sectional representation of the hydraulic distribution unit showing the circuits relative to the line B. In the right-hand part of the Figure is shown, as for circuit A, a longitudinal bore 174*b* extending through the mass of the block 150. In this bore is located the actual valve body in which the spool moves. Since the three distribution valves relative to the lines A, B and C are identical, the valves of the B pressure circuits (FIG. 7) and of the C pressure circuits (FIG. 8) will not be described. At respective ends of the spool are located the pistons 90*b* and 88*b* whose section ratio is 1 to 0.8. The pressure A acts on a face of the piston 90*b* through the channel 212 communicating with the annular chamber 166 at the pressure A. The other face of the piston is subjected to the purge pressure through the channel 214 communicating with the annular chamber 168 of the purge circuit. The utilization channel 216 of the distribution valve can be connected either to the exterior pressure (purge circuit) thanks to a radial channel 218 communicating with the annular purge chamber 168 for the position of the spool shown in FIG. 7, or to the pressure B through the annular channel 220 which is found in the left-hand part of FIG. 7. The pressure B acts on one of the two faces of the piston 88*b* through a channel 222 communicating with the annular chamber 170 at the pressure B. The other face of the piston is in communication with the exterior pressure through the communication and volume-balancing channel 124*b*. The upper and lower ends of the longitudinal bore 174 *b* are closed by plugs 224 and 226 respectively.

A longitudinal passage 228 (left-hand part of FIG. 7) goes through the hydraulic unit. Its upper part is closed by a plug 230 comprising a filter 232. Its lower part is closed by the nonreturn valve 110 allowing the passage of the hydraulic fluid only from the channel 228 to the annular chamber 170 at the pressure B.

FIG. 8 shows a section of the hydraulic unit along a plane showing the hydraulic circuits relative to the line C. In the left-hand part of the figure, the line C is screwed at the end of a longitudinal passage 233 of a plug 234. A filter 236 is placed behind the plug. The hydraulic fluid at the pressure C first of all goes through a channel 238, then opposite the nonreturn valve 118 (without being able to enter it) and up to the inlet 241 of the calibrated valve 114 through the passage 240. The fluid is directed toward this valve, provided however that the pressure C is higher than about 140 bars (2000 psi) up to the outlet 243 of the valve. Through a passage not shown, the hydraulic fluid at the pressure C is led into the chamber 242 and into the channel 244 of the distribution valve 84 shown in the right-hand part of FIG. 8. The hydraulic unit has, over its entire length, a longitudinal bore 174*c* containing the valve 84. The spool of this valve is surrounded by two pistons 88*c* and 90*c* whose section ration is 1 to 0.6. The inside faces of the pistons 88*c* and 90*c* are subjected to the pressure of the purge circuit 168 through the passages 246 and the longitudinal passage 124*c* inside the spool. The outside face of the piston 88*c* is subjected to the pressure C through the chamber 242. The outside face of the piston 90*c* is subjected to the pressure of the line B through the channel 248 communicating with the annular chamber 170 at the pressure B. The utilization port 250 of the valve is either at the pressure of the purge circuit through the channel 252 (for the position of the spool shown in FIG. 8) or at the pressure C for the other position of the spool through the channel 244. The longitudinal hollow 174*c* in the hydraulic unit is closed at its upper and lower ends by plugs 254 and 256 respectively.

The present invention is not limited to the embodiment represented here by way of example, but is defined by the appended claims. In particular, the embodiment described concerns the hydraulic control of an underwater valve. Skilled artisans will recognize that the present invention is applicable whenever it is desired to rapidly control an element remotely by hydraulic means.

We claim:

1. A method for the remote hydraulic control of a device coupled to a hydraulic source by at least one flexible line filled with hydraulic fluid, comprising the steps of hydraulically isolating said at least one line from said device; accumulating hydraulic energy in said at least one line by increasing the pressure of said hydraulic fluid to deform said at least one line; and making available the hydraulic energy thus accumulated for rapid control of said device by remotely and controllably establishing hydraulic communication between said at least one line and said device.

2. The method of claim 1, wherein the step of isolating said at least one line from said device is performed by means of a distribution valve unit which enables accumulation of hydraulic energy in said at least one line without actuating said devices.

3. The method of claim 2, further comprising the step of controlling the distribution valve unit by means of hydraulic fluid pressure from said hydraulic source.

4. A method for the remote hydraulic control of a hydraulically actuated well valve, placed below the surface in a well, coupled to a hydraulic source at the surface by at least two flexible lines filled with hydraulic fluid and used for actuating said well valve, comprising the steps of hydraulically isolating at least one of said flexible lines from said well valve; increasing hydraulic pressure in said at least one of said flexible lines to expand said at least one of said flexible lines in volume in order to accumulate hydraulic energy therein; and in response to remotely induced change in the relative hydraulic pressures in said flexible lines, controllably releasing said accumulated hydraulic energy in said at least one of said flexible lines to said well valve for rapid actuation of said well valve.

5. The method of claim 4, wherein the step of accumulating hydraulic energy in said at least one of said flexible lines comprises isolating said well valve from said at least one of said flexible lines by means of a hydraulic distribution valve unit which enables hydraulic energy to be accumulated in said flexible lines without actuating said well valve.

6. The method of claim 5, wherein said step of controllably releasing said accumulated hydraulic energy comprises varying pressure in any of said flexible lines to operate said hydraulic distribution valve unit in order to enable release of the accumulated hydraulic energy in said at least one of said flexible lines to actuate said well valve.

7. The method of claim 4, wherein said flexible lines are controllably uncoupleable from said well valve by means of hydraulic pressure, further comprising the steps of:

hydraulically isolating another of said flexible lines from said well valve;

increasing hydraulic pressure in said another of said flexible lines to expand said another of said flexible lines in volume in order to accumulate hydraulic energy therein; and controllably releasing said accumulated hydraulic energy in said another one of said flexible lines to uncouple said flexible lines from said well valve.

* * * * *